US007022655B2

(12) United States Patent
Brask et al.

(10) Patent No.: US 7,022,655 B2
(45) Date of Patent: Apr. 4, 2006

(54) HIGHLY POLAR CLEANS FOR REMOVAL OF RESIDUES FROM SEMICONDUCTOR STRUCTURES

(75) Inventors: Justin K. Brask, Portland, OR (US); Robert B. Turkot, Jr., Hillsboro, OR (US); Vijayakumar S. Ramachandrarao, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 309 days.

(21) Appl. No.: 10/454,109

(22) Filed: Jun. 4, 2003

(65) Prior Publication Data

US 2004/0097388 A1 May 20, 2004

Related U.S. Application Data

(62) Division of application No. 10/295,150, filed on Nov. 15, 2002, now Pat. No. 6,624,127.

(51) Int. Cl.
*C11D 7/50* (2006.01)

(52) U.S. Cl. ..... 510/175; 510/407

(58) Field of Classification Search ..... 568/454, 568/451; 95/51, 52; 510/175, 176, 177; 134/2, 3

See application file for complete search history.

(56) References Cited

U.S. PATENT DOCUMENTS

| | | | | |
|---|---|---|---|---|
| 6,579,343 | B1 * | 6/2003 | Brennecke et al. | 95/51 |
| 6,624,127 | B1 * | 9/2003 | Brask et al. | 510/175 |
| 2003/0085156 | A1 * | 5/2003 | Schoonover | 208/230 |
| 2004/0097388 | A1 * | 5/2004 | Brask et al. | 510/175 |

FOREIGN PATENT DOCUMENTS

DE 10123467 A1 * 11/2002

OTHER PUBLICATIONS

"Green Processing Using Ionic Liquids and CO2", Nature, vol. 399, May 6, 1999, Macmillan Magazine Ltd., pp. 28, 29.*

* cited by examiner

*Primary Examiner*—Gregory Webb
(74) *Attorney, Agent, or Firm*—Trop, Pruner & Hu, P.C.

(57) ABSTRACT

Supercritical carbon dioxide may be utilized to remove resistant residues such as those residues left when etching dielectrics in fluorine-based plasma gases. The supercritical carbon dioxide may include an ionic liquid in one embodiment.

5 Claims, No Drawings

HIGHLY POLAR CLEANS FOR REMOVAL OF RESIDUES FROM SEMICONDUCTOR STRUCTURES

This application is a Divisional of U.S. application Ser. No. 10/295,150, filed Nov. 15, 2002, now U.S. Pat. No. 6,624,127.

BACKGROUND

This invention relates generally to processes for manufacturing semiconductor integrated circuits and, particularly, to the removal of etch residues.

Fluorine-based plasma etching is commonly used to etch photoresist to generate patterns on a semiconductor device. A residue is left behind on the etched wafer that essentially includes constituents of the plasma gas and the material etched. Normally, gases composed of carbon and fluorine are used for plasma etching resulting in a residue containing carbon and fluorine. Further, the residue may be polymerized due to the generation of free radicals and ions in the high-energy plasma environment.

With photoresists in advanced semiconductor processes, such as the 193 nm photoresist, wherein a fluorine-rich plasma etch is used, and with 157 nm, wherein the photoresist itself is fluorine-based the etch residue may be difficult to remove. This residue may include carbon, hydrogen, and fluorine, and is highly chemically inert and is, therefore, relatively difficult to remove with conventional wet chemical etches. The use of delicate interlayer dielectrics, including porous materials, may prevent the use of ashing for residue removal. Conventional wet cleans may not work well with this relatively inert chemical residue. Few liquid solvents can penetrate fluorine-based polymers like teflon.

Thus, there is a need for a better way to remove resistant etch residues.

DETAILED DESCRIPTION

Supercritical carbon dioxide has gas-like diffusivity and viscosity and liquid-like densities, while being almost chemically inert. Hence a host of chemically reactive agents may almost always be used in conjunction during supercritical carbon dioxide-based cleans. Carbon dioxide becomes supercritical at temperatures above 30° C. and pressures above 1000 pounds per square inch. A fluid is considered to be supercritical when its pressure and temperature are above the critical values.

A variety of chemically reactive agents are soluble in supercritical carbon dioxide, such as the solvents dimethyl acetamide (DMAC), sulfolane, organic peroxides, ethers, glycols, organic bases, and strong organic and mineral acids, to mention a few examples. The higher degree of swelling of the fluorine-based residue by fluorocarbons dissolved in supercritical carbon dioxide and increased diffusion of supercritical carbon dioxide and the dissolved reagents therein (fluorocarbons and the other chemical reagents) may enhance residue deterioration and removal. A high flow rate of supercritical carbon dioxide may lend the ability to use highly reactive chemicals as opposed to conventional wet chemistries, which have a long contact time with the dielectric material.

Ionic liquids are salts that exist in liquid form at temperatures from 10 to 200° C. Ionic liquids have a positive and negative charge. They exhibit low viscosity and no measurable vapor pressure. Ionic liquid can dissolve a range of organic, inorganic, and polymeric materials at high concentrations. Generally, ionic liquids are non-corrosive. Examples of ionic liquids include salts of alkylmethylimidazolium.

A member from the imidazolium family of ionic liquids may be combined with supercritical carbon dioxide to increase variability and polarity and hence selectivity for various cleaning applications. The ionic liquid may be mixed into supercritical carbon dioxide in a way that the ionic liquid is fully, or only partially, miscible in the carbon dioxide medium, depending on the application.

By mixing ionic liquids with supercritical carbon dioxide, clean chemistries with high polar variability may be achieved. For example, derivatives of 1-butyl-3-methylimidazolium hexafluorophosphate may be used which are partially miscible with supercritical carbon dioxide.

The addition of highly polar ionic liquids in various stoichiometries to supercritical carbon dioxide provides a broader range of tunable polarities, enabling variation and selectivity for material cleaning. Moreover, such liquids have effectively zero vapor pressure and, therefore, they can be recycled upon heating. The particles and solutes are degraded and then can be filtered or separated off. In addition, other ionic liquids may also be used with supercritical carbon dioxide. One may pick and choose among the various available ionic pairs to make a liquid that fits a particular need such as dissolving certain chemicals in a reaction or extracting specific molecules from solution.

Supercritical carbon dioxide may be forced through a solution containing the undesired material and an ionic liquid. The carbon dioxide in its supercritical state may be near room temperature but is highly pressurized. The supercritical carbon dioxide may have a liquid consistency yet, like a gas, expands to fill the available space. When droplets of supercritical carbon dioxide are forced through an ionic liquid, the carbon dioxide can pull impurities out of the ionic liquid while leaving the ionic liquid unchanged. Carbon dioxide is sufficiently soluble in 1-butyl-3-methylimidazolium hexafluorophosphate to reach a mole fraction of 0.6 at 8 MPa. Blanchard, Lynette A. et al., Nature, 399, 28–29 (1999).

Dissolved fluorocarbons or other reagents in supercritical carbon dioxide may be quickly transported into residues left after fluorine-based etches of photoresist due to the high diffusivity of supercritical carbon dioxide and, particularly, the diffusivity of supercritical carbon dioxide in polymers and small molecules in polymers swollen by supercritical carbon dioxide. Since the fluorocarbons are chemically similar to the etch residue, the etch residue swells. This further increases the access of the supercritical carbon dioxide into the interior of the etch-residue and weakens the residue. The fluorocarbon also breaks into the hard crust of the residue, which the supercritical carbon dioxide by itself may be unable to enter and swell, to introduce the reactive agents into the residue. Addition of an ionic liquid to the above supercritical carbon dioxide/fluorocarbon mixture allows for polar variability/tunibility of said mixture.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A cleaning material comprising:

supercritical carbon dioxide;

an ionic liquid; and a co-solvent including fluorine substituents.

2. The material of claim 1 wherein said ionic liquid is only partially miscible in supercritical carbon dioxide.

3. The material of claim 1 wherein said ionic liquid is fully miscible in supercritical carbon dioxide.

4. The material of claim 2 or 3 wherein said ionic liquid includes an imidazolium compound.

5. The material of claim 4 wherein said compound is 1-butyl-3-methylimidazolium hexafluorophosphate.

* * * * *